US010625343B2

(12) United States Patent
Vinod Agarwal et al.

(10) Patent No.: US 10,625,343 B2
(45) Date of Patent: Apr. 21, 2020

(54) PROCESS FOR THE PREPARATION OF METAL NANOPARTICLES

(71) Applicant: Council of Scientific and Industrial Research, Rafi Marg, New Delhi (IN)

(72) Inventors: Sankalp Vinod Agarwal, Hyderabad (IN); Shyam Sunder Reddy, Hyderabad (IN); Marshal, Hyderabad (IN)

( * ) Notice: Subject to any disclaimer, the term of this patent is extended or adjusted under 35 U.S.C. 154(b) by 132 days.

(21) Appl. No.: 15/033,741

(22) PCT Filed: Oct. 31, 2014

(86) PCT No.: PCT/IN2014/000695
§ 371 (c)(1),
(2) Date: May 2, 2016

(87) PCT Pub. No.: WO2015/063794
PCT Pub. Date: May 7, 2015

(65) Prior Publication Data

US 2016/0263657 A1 Sep. 15, 2016

(30) Foreign Application Priority Data

Nov. 1, 2013 (IN) ..... 3245/DEL/2013

(51) Int. Cl.
*B22F 9/24* (2006.01)
*B22F 1/00* (2006.01)

(52) U.S. Cl.
CPC ..... *B22F 9/24* (2013.01); *B22F 1/0018* (2013.01); *B22F 1/0044* (2013.01); *B22F 2009/245* (2013.01); *B22F 2301/255* (2013.01); *B22F 2302/45* (2013.01)

(58) Field of Classification Search
None
See application file for complete search history.

(56) References Cited

U.S. PATENT DOCUMENTS 6,572,673 B2 6/2003 Lee et al.
6,660,058 B1 12/2003 Oh et al.
7,138,468 B2 * 11/2006 McCormick, III .... B82Y 30/00 526/89
7,850,933 B2 12/2010 Yang et al.
7,867,316 B2 1/2011 Jun et al.
(Continued)

OTHER PUBLICATIONS

Daniel, M-C. et al., "Gold Nanoparticles: Assembly, Supramolecular Chemistry, Quantum-Size-Related Properties, and Applications toward Biology, Catalysis, and Nanotechnology", Chemical Reviews, vol. 104, pp. 293-346, Published on Web Dec. 20, 2003.*
(Continued)

*Primary Examiner* — George Wyszomierski
(74) *Attorney, Agent, or Firm* — Daniel R. Evans; Merchant & Gould P.C.

(57) ABSTRACT

Invention provides a one step process for the preparation of metal nanoparticles which are stable at room temperature under normal storage condition for more than 6 months, retain their colloidal and dispersive nature at neutral, acidic (pH <7) and basic (pH >7) pH conditions and can maintain their stability and colloidal nature at low (while frozen), high temperatures and pressure, from water soluble metal chlorides and hydrides.

16 Claims, 5 Drawing Sheets

(56) References Cited

U.S. PATENT DOCUMENTS

| | | | | |
|---|---|---|---|---|
| 8,084,558 | B2 | 12/2011 | McCormick, III et al. | |
| 8,304,257 | B2 * | 11/2012 | Ackerson | B22F 1/0018 436/525 |
| 9,771,380 | B2 * | 9/2017 | Hutchison | C07F 1/005 |
| 2006/0148104 | A1 * | 7/2006 | Marini | B82Y 5/00 436/524 |
| 2006/0183247 | A1 * | 8/2006 | Kim | A61K 49/0065 436/524 |
| 2007/0044591 | A1 * | 3/2007 | Yang | B22F 1/0018 75/370 |
| 2009/0226753 | A1 * | 9/2009 | Naoi | B22F 1/0025 428/606 |
| 2009/0283726 | A1 * | 11/2009 | Mizoguchi | A61K 8/30 252/582 |
| 2011/0192714 | A1 * | 8/2011 | Liu | B01J 19/121 204/157.41 |
| 2012/0177897 | A1 * | 7/2012 | Jablonski | B22F 1/0022 428/208 |
| 2012/0202218 | A1 * | 8/2012 | Liedberg | B82Y 15/00 435/7.4 |

OTHER PUBLICATIONS

Xu, F. et al., "Simple one-step synthesis of gold nanoparticles with controlled size using cationic Gemini surfactants as ligands: Effect of the variations in concentrations and tail lengths", Colloids and Surfaces A: Physicochemical and Engineering Aspects, vol. 417, pp. 201-210, Available online Nov. 9, 2012.*

Kihyun Kwon et al., "Controlled Synthesis of Icosahedral Gold Nanoparticles and Their Surface-Enhanced Raman Scattering Property", Journal of Physical Chemistry C., 111(3):1161-1165 (2006).

Alexander Kraynov et al., "Concepts for the Stabilization of Megal Nanoparticles in Ionic Liquids", Applications of Ionic Liquids in Science and Tehnology, InTech:235-260 (2011).

Sankalp Vinod Agarwal et al., "Ultra-small gold nanoparticles synthesized in aqueous solution and their application in fluorometric collagen estimation using bi-ligand functionalization", RSC ADV., 4(35):18250-18256 (2014).

International Search Report and Written Opinion for PCT/IN2014/000695, dated May 21, 2015.

International Preliminary Report on Patentability for PCT/IN2014/000695, dated Jan. 21, 2016.

* cited by examiner (a) (b) (c) (d)

PROCESS FOR THE PREPARATION OF METAL NANOPARTICLES

This application is a National Stage Application of PCT/IN2014/000695, filed 31 Oct. 2014, which claims benefit of Serial No. 3245/DEL/2013, filed 1 Nov. 2013 in India and which applications are incorporated herein by reference. To the extent appropriate, a claim of priority is made to each of the above disclosed applications.

FIELD OF THE INVENTION

The present invention relates to a one step process for the preparation of metal nanoparticles from water soluble metal chlorides and hydrides. Particularly, the present invention relates to a process for the preparation of metal nanoparticles which are stable at room temperature under normal storage condition for more than 6 months, retain their colloidal and dispersive nature at neutral, acidic (pH <7) and basic (pH >7) pH conditions and can maintain their stability and colloidal nature at low (while frozen), high temperatures and pressure.

BACKGROUND AND PRIOR ART OF THE INVENTION

Recent developments in nanotechnologies have focused on developing methods for synthesizing smaller and functional nano-structures/particles which can have better uses due to unique functional characteristics associated with nano-size/structures in industries such as biomedical, Chemical, energy, electronics, etc. [O. V. Salata, Journal of Nanobiotechnology, 2004, 2, 3]. For most of these applications metal nanoparticles have been synthesized by reduction of metal salts in both polar and non-polar solvents [Y. Li, S. Liu, T. Yao, Z. Sun, Z. Jiang, Y. Huang, H. Cheng, Y. Huang, Y. Jiang, Z. Xie, G. Pan, W. Yan, S. Wei, Dalton Trans., 2012, 41.]. The uses of non-polar solvents are preferred in many applications because of its advantage in retaining the activity of reducing agents for longer time [N. Zheng, J. Fan, G. D. Stucky, J. Am. Chem. Soc., 2006, 128, 6550]. Jun et. al. [B. H. Jun, D. H. Kim, K J Lee, U.S. Pat. No. 7,867,316B2, 2011] had described a method for manufacturing metal nanoparticles in which metal precursors were dissolved in a non-polar solvent and capping molecule solution was prepared in non-polar solvent. The used methods required heating of these solutions from 60 to 120° C. for an hr to synthesize nanoparticles of <20 nm. Lee and Wan [C. L. Lee and C. C. Wan, U.S. Pat. No. 6,572,673B2, 2003] developed a process to prepare metal nanoparticles by comprising the use of reacting metal salts and reducing agents having anionic groups, sulfate or sulfonate groups. In this method $NaBH_4$ was used as reducing agent in water with surfactants to achieve size control synthesis of metal nanoparticles. Yang et. al. [Z. Yang, H Wang, Z Xu, U.S. Pat. No. 7,850,933B2, 2010] had described a method for synthesis of nanoparticles from metal chloride solution prepared in water and it required heating at 50-140° C. McCormick et. al. [C. L. McCormick, Andrew B. Lowe, B. S. Sumerlin, U.S. Pat. No. 8,084,558 B2, 2011] were able to prepare thiol-functionalized transition metal nanoparticles and subsequently achieving surface modification with co-polymers. Oh et. al. [S. G. Oh, S. C. Yi, S. Shin, D. W. Kim, S. H. Jeong, U.S. Pat. No. 6,660,058 B1, 2003] had highlighted the use surfactant in solutions, which have intrinsic property to adsorb into the two interfaces of different phase, to prepare silver and silver alloyed nanoparticles. The methods described above, either requires using organic solvents for the synthesis or are multistep process for the synthesis of metal nanoparticles.

Reference may be made to journal, "Journal of Nanobiotechnology, 2004, 2, 3" by Salata, wherein recent developments in nanotechnologies have focused on developing methods for synthesizing smaller and functional nano-structures/particles which can have better uses due to unique functional characteristics associated with nano-size/structures in industries such as biomedical, Chemical, energy, electronics, etc.

Reference may be made to journal, Dalton Trans., 2012, 41, 11725-11730 by Li et al wherein metal nanoparticles have been synthesized by reduction of metal salts in both polar and non-polar solvents.

Reference may be made to journal, "J. Am. Chem. Soc., 2006, 128, 6550" by Zheng et al wherein the uses of non-polar solvents are preferred in many applications because of its advantage in retaining the activity of reducing agents for longer time.

Reference may be made to U.S. Pat. No. "7,867,316B2, 2011" by Jun et al wherein a method for manufacturing metal nanoparticles in which metal precursors were dissolved in a non-polar solvent and capping molecule solution was prepared in non-polar solvent. The used methods required heating of these solutions from 60 to 120° C. for an hr to synthesize nanoparticles of <20 nm.

Reference may be made to U.S. Pat. No. "6,572,673B2, 2003" by Lee and Wen wherein a process to prepare metal nanoparticles by comprising the use of reacting metal salts and reducing agents having anionic groups, sulfate or sulfonate groups. In this method $NaBH_4$ was used as reducing agent in water with surfactants to achieve size control synthesis of metal nanoparticles.

Reference may be made to U.S. Pat. No. "7,850,933B2, 2010" by Yang et al wherein describe the method for synthesis of nanoparticles from metal chloride solution prepared in water and it required heating at 50-140° C.

Reference may be made to U.S. Pat. No. "8,08,4558 B2, 2011" by McCormick et al wherein thiol-functionalized transition metal nanoparticles was prepared and subsequently achieving surface modification with co-polymers.

Reference may be made to U.S. Pat. No. "6,660,058 B1, 2003" by Oh et al wherein describe the use of surfactant in solutions, which have intrinsic property to adsorb into the two interfaces of different phase, to prepare silver and silver alloyed nanoparticles.

In non-polar solvent methods highly monodisperse nanoparticles can be achieved, due to the controlled reduction of metal precursors by the use of reducing chemicals. This makes nonpolar solvent to be desirable in most of the methods used for synthesis of metal nanoparticles. Despite of several advantages these processes for nanoparticle synthesis require multiple steps to control the size of nanoparticles and to achieve higher stability. Secondly the use of most of non-polar solvents is not desirable for their cost effectiveness and adverse effects on the environment.

Developing methods for rapid and cost effective synthesis of metal nanoparticles in polar solvent can be desirable. However, there are not many reports and methods which specifically describe the role of reducing chemicals in these solvents in which the strong reducing power of these in water can be utilized for the reduction of metal salts. Hence there is an urgent need for developing methods for synthesis of metal nanoparticles at room temperature.

OBJECTIVES OF THE INVENTION

Main objective of the present invention is to provide a one step process for the preparation of metal nanoparticles from water soluble metal chlorides and hydrides.

Another object of the present invention is to provide rapid synthesis of highly dispersed metal particles using reducing chemicals such as $LiBH_4$ in polar solvents.

Yet another object of the present invention is to develop methods for preparation of various size of metal nanoparticles (2, 5, 20 and 30 nm) from the water soluble metal chlorides and hydrides.

Yet another object of the present invention is to develop a process in which the synthesized metal nanoparticles will be highly colloidal and dispersive in nature and have longer stability at room temperature.

Yet another object of the present invention is to develop a process to test the stability of these metal nanoparticles in different physical, chemical and biological environments, which can maintain their colloidal and dispersive nature at different pH ranging from 3 to 12.

Yet another object of the present invention is to develop a process for making metal nanoparticles that should maintain their colloidal nature at high temperature (tested at room temperature (25 to 35° C.) and ~120° C. and pressure (atmospheric pressure and 15 lbs).

Yet another object of the present invention is to provide a method for synthesis of ultra small particle size (~2 nm) which can provide greater surface to area ratio for different applications.

Yet another object of the present invention is to provide a simple one step method for synthesis of metal particles which overcome complications of other tedious and cumbersome process.

SUMMARY OF THE INVENTION

Figure 1:
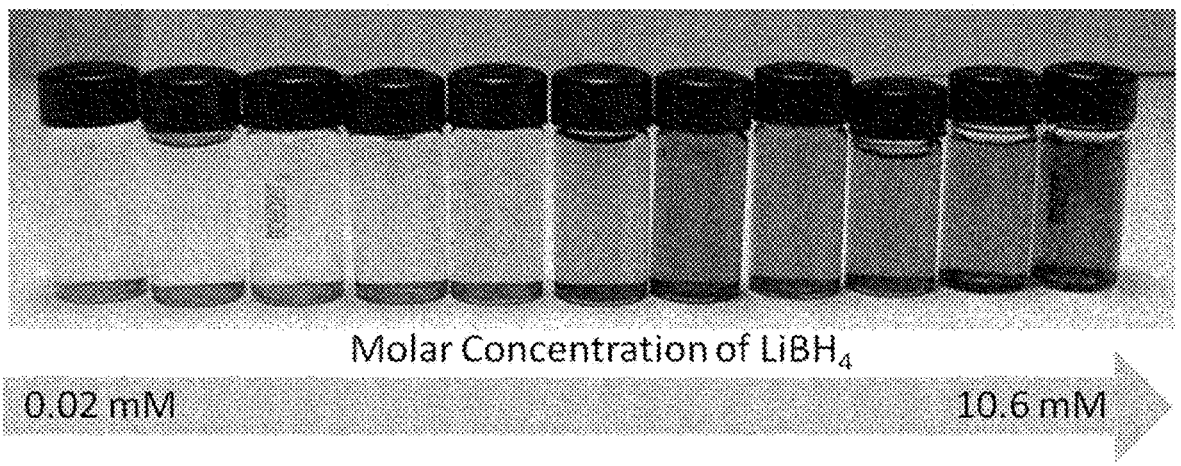
FIG. 1 is a perspective view of the optical images of colloidal suspension of gold nanoparticles at various $LiBH_4$ molar concentrations (0.02 mM, 0.04 mM, 0.08 mM, 0.17 mM, 0.33 mM, 0.66 mM, 1.32 mM, 2.64 mM, 5.28 mM, 8 mM and 10.56 mM) in $AuCl_3$ aqueous solution at room temperature [25° C.]. In this invention the particle size can be controlled by varying the concentration of reducing agent. This is evident from the color gradient in colloidal suspension as shown in FIG. 1.

Accordingly, present invention provides a process for the preparation of metal nanoparticles comprising the steps of:)

preparing aqueous solution of metal salt;

b) preparing reducing agent solution;

c) stirring reducing agent solution as obtained in step (b) with the solution as obtained in step (a) for period in the range of 1 to 15 minutes at temperature in the range of 25 to 35° C. to obtain metal nanoparticles.

In an embodiment of the present invention, metal salts used is selected from the group consisting of $AuCl_3$, AgCl, $HAuCl_4$, $RuCl_3$, $H_2PtCl_6$, $PdCl_2$, $CuCl_2$ and $PtCl_4$.

In yet another embodiment of the present invention, reducing agent solution is prepared in water or metal salt solution as obtained in step (a).

In yet another embodiment of the present invention, reducing agent solution prepared in metal salt solution as obtained in step (a) is directly stirred in step (c) for period in the range of 5 to 15 minutes to obtain metal nanoparticles.

In yet another embodiment of the present invention, the reducing agent used to prepare solution in water is $LiBH_4$.

In yet another embodiment of the present invention, the reducing agent used to prepare solution in metal salt solution as obtained in step (a) is selected from the group consisting of $LiBH_4$, $NaBH_4$, citrate, hydrazine, MBA, amine borates and phosphorous acid.

In yet another embodiment of the present invention, reducing agent solution prepared in metal salt solution as obtained in step (a) is directly stirred in step (c) for period in the range of 1 to 15 minutes to obtain metal nanoparticles.

In yet another embodiment of the present invention, said nanoparticles are stable at pH ranging from 3-12.

In yet another embodiment of the present invention, said nanoparticle exhibit stability of their colloidal nature at temperature in the range of 4 to 130° C. and pressure in the range of atmospheric pressure to 15 lbs.

In yet another embodiment of the present invention, said metal nanoparticles are useful for the sensing nanoprobes as ligand functionalised metal nanoparticles.

In yet another embodiment, present invention provides a process for the preparation of ligand functionalized metal nanoparticles comprising the steps of:

a) Incubation of larger molecules with metal NPs, b) Incubation of small size molecules on large molecules functionalized metal NPs as obtained in step (a).

In yet another embodiment of the present invention, functional AuNPs and bi-ligand functionalized AuNPs to use for detection of molecules having high affinity with AuPs by replacement/release of functionalized molecules present on AuNP surface.

In yet another embodiment of the present invention, said metal nanoparticles size is in the range of ~2 to 5 nm showing strong surface Plasmon resonance (SPR), can maintain colloidal natural at both acidic (3, 5, 7) and basic pH (9, 10, 10.6), stable at room temperature (25-35° C.) for more than 6 months.

DETAILED DESCRIPTION OF THE INVENTION

As used here-in, metal nanoparticles are referred to both ultra small nanoparticles, which have an average diameter ~2 nm, and nanoparticles that referred to the metal particles having average diameter >2 nm.

The present invention provides simple and rapid method for production of metal nanoparticles from the metal precursor (metal hydrides and chlorides) in presence of reducing agent such as $LiBH_4$. The method for synthesis of metal nanoparticles can be described as follows: appropriate molar concentrations of metal chlorides/hydrides were dissolved in polar solvent such as water and allowing it to react with solid $LiBH_4$ in controlled way. It is very unique process as in this only one step is required, and the metal chlorides/hydrides aqueous solution were used to dissolve reducing agent for instantaneous formation of metal particles. In this method the rapid synthesis occurs because $LiBH_4$ rapidly oxidized when it comes in contact with aqueous metal chlorides/hydrides solution.

The present invention provides preparation of metal nanoparticles with a series of reducing chemical solutions such as $LiBH_4$ were prepared by dissolving these in metal chlorides/hydrides aqueous solution at room temperature. This facile synthesis method was used to control the particle size by varying the reducing chemical molar concentration in chlorides/hydrides aqueous solution. It has been observed that these metal particles are highly colloidal and dispersive in nature and are also stable for more than six months at room temperature [25-35° C.].

The present invention provides different physical and chemical environments were created and it has been observed that these metal particles maintain their colloidal and dispersive nature at different pH (3, 5, 7, 9, 10, 10.6) ranging in between 3 to 12. Moreover, particles synthesized by using this invention can tolerate high sodium chloride concentration and can maintain their colloidal nature at high temperature and pressure.

The technique used in this invention involves unique combinations of adding reducing agents and metal precursors in an aqueous solution. This process can produce instantaneous well dispersed ultra-small metal nanoparticles of an average diameter ~2 nm. The same methods in this invention can also be used to make metal nanoparticles of average diameter >2 nm by changing the ratio of reducing agent and metal salt molar concentration. A wide range of metal particle size can achieved by selecting appropriate molar proportion of reducing agent and metal chlorides/hydrides dissolved in aqueous solution.

Using this invention ultra-small metal nanoparticle (particles average diameter ~2 nm) was achieved. These metal particles were used to attach several organic and inorganic molecules.

The present invention describes The preparation of these particles in polar solvents such as aqueous solution of metal particles in this invention have several advantages for their applications in nano-drugs, drug delivery, biomedical diagnostics, cell imaging, and compatibility with biomolecules where non-polar solvents are not desirable to use at several physiological conditions.

In this invention a series of different molar concentrations of $LiBH_4$ solutions were prepared by dissolving in metal chloride containing Milli Q water. FIG. 1 shows representative optical images of gold nanoparticles colloidal suspension. At lower $LiBH_4$ molar concentration, which was increased from 0.17 mM to 1.32 mM, showed a light blue color of colloidal solution whereas further increase in the molar concentration of it from 2.64 mM to 10.56 mM showed the red wine colour of these particles colloidal suspension.

Figure 2:
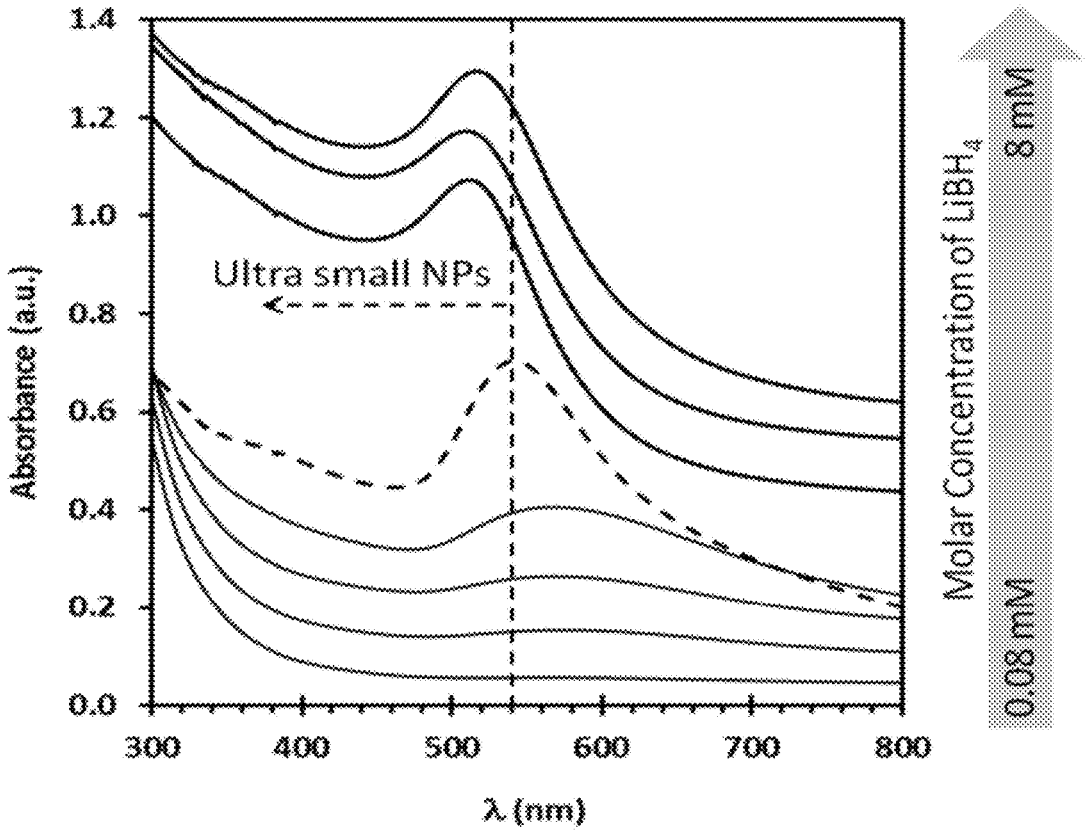
FIG. 2 is a perspective view of the UV-vis spectra of gold nanoparticles colloidal suspension synthesized at various $LiBH_4$ molar concentrations (0.08 mM, 0.17 mM, 0.33 mM, 0.66 mM, 1.32 mM, 2.64 mM, 5.28 mM, 8 mM) in $AuCl_3$ aqueous solution at room temperature [25° C.].

FIG. 2 shows representative UV-Vis spectra of gold nanoparticles colloidal suspension synthesized at various $LiBH_4$ molar concentrations (0.08 mM, 0.17 mM, 0.33 mM, 0.66 mM, 1.32 mM, 2.64 mM, 5.28 mM, 8 mM) at room temperature [25° C.]. By using this invention, the developed methods can control the particle size by varying the reducing agent concentration. This can also be evident from the colour change in colloidal suspension as shown in FIG. 1.

Figure 3:
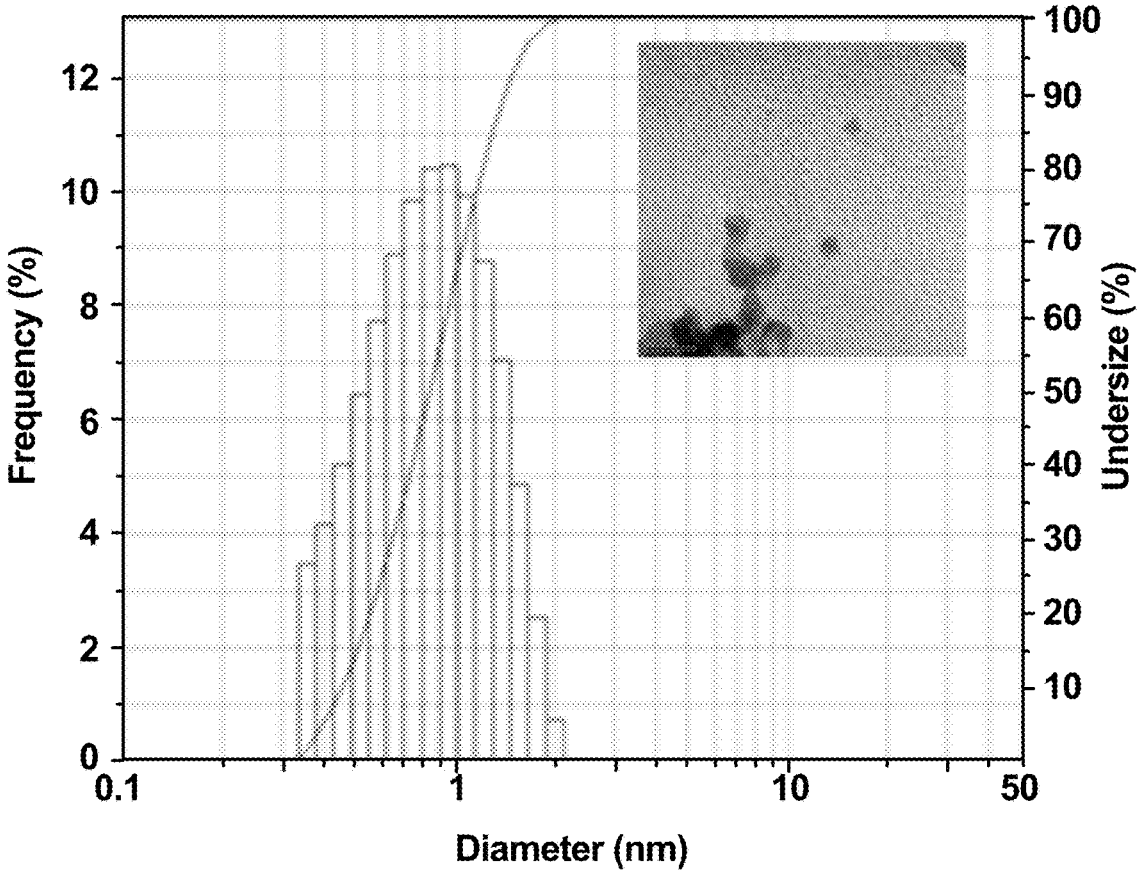
FIG. 3 is a perspective view of the dynamic light scattering (DLS) and transmission electron microscopy (TEM) images of ultra small (~2 nm) gold nanoparticles synthesized at 2.64 mM $LiBH_4$ concentration in $AuCl_3$ aqueous solution at room temperature [25° C.].

This invention also has uniqueness for producing ultra small metal nanoparticles which are difficult in other methods. Representative information to determine the size of ultra small gold nanoparticles was obtained from DLS and TEM as shown in FIG. 3. Metal particles produced by using methods described in this invention are highly colloidal and dispersive in nature. These particles are dispersed in water even after six months while storage at room temperature [25-35° C.].

Figure 4:
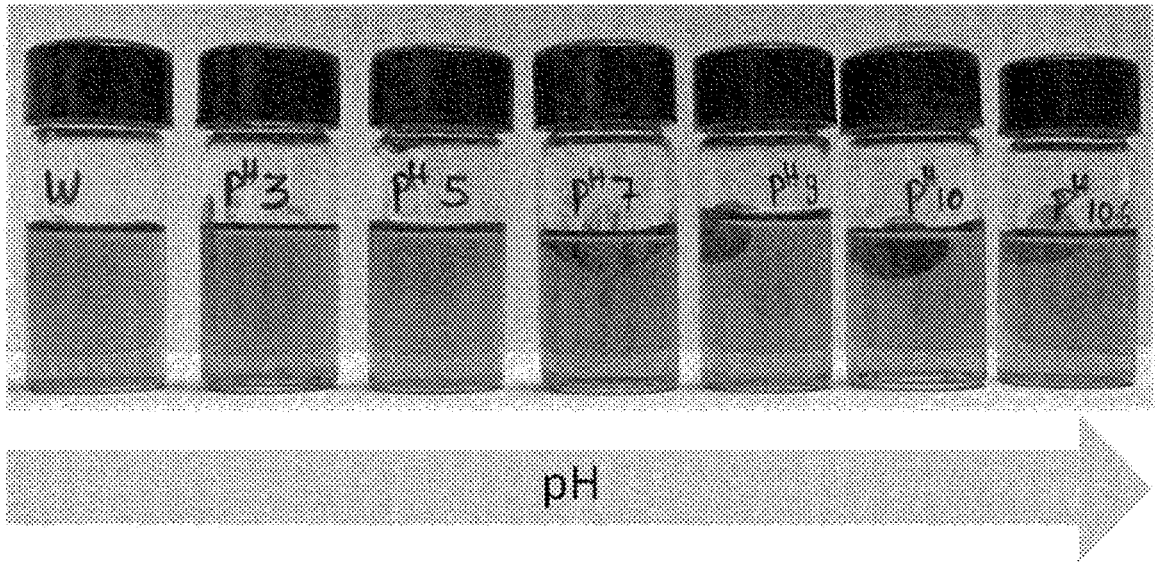
FIG. 4 is a perspective view of the optical images of gold nanoparticles colloidal suspension synthesized at 2.64 mM $LiBH_4$ dissolved in $AuCl_3$ aqueous solution at room temperature [25° C.] and exposed to various pH buffer solutions [3, 5, 7, 9, 10 and 10.6 pH of the colloidal solution]. The variation in pH of the colloidal solution was achieved as: citrate buffer used for variation of pH from 3 to 5, phosphate buffer was used for changing pH from 5 to 8 and NaOH—HCl buffer was used to change pH from 9 to 10.6.

Using this invention, the particles synthesized can maintain their colloidal and dispersive nature at different pH (3, 5, 7, 9, 10, 10.6) ranging in between 3 to 12 and as a representative optical image of colloidal suspension are shown in FIG. 4. Production of metal particles by this invention can used to prepare highly stable particles in different types of physical, chemical and biological environments. Moreover, these metal particles can tolerate high sodium and other alkali metal chlorides concentration and can maintain their colloidal stability at high temperatures (tested at room temperature and ~120° C.) and pressure (atmospheric pressure and 15 lbs).

Using this invention water based facile synthesis of ultra small metal particle size was achieved which has greater surface to area ratio and used for the attachment of various organic and inorganic molecules. The used method in this invention can be extended to use other reducing agents like $LiAlH_4$ and other alkali metal alanides, $NaBH_4$ and other alkali metal borohydrates, citrate, hydrazine, MBA, amine borates, phosphorus acid etc in aqueous based synthesis of metal particles. The metal particles synthesized by the methods used in this invention can tolerate higher concentration of biomolecules used for functionalization. These metal particles can be uni- and co-functionalized by different functional groups of organic and inorganic molecules to produce janus nanoparticles.

Figure 5:
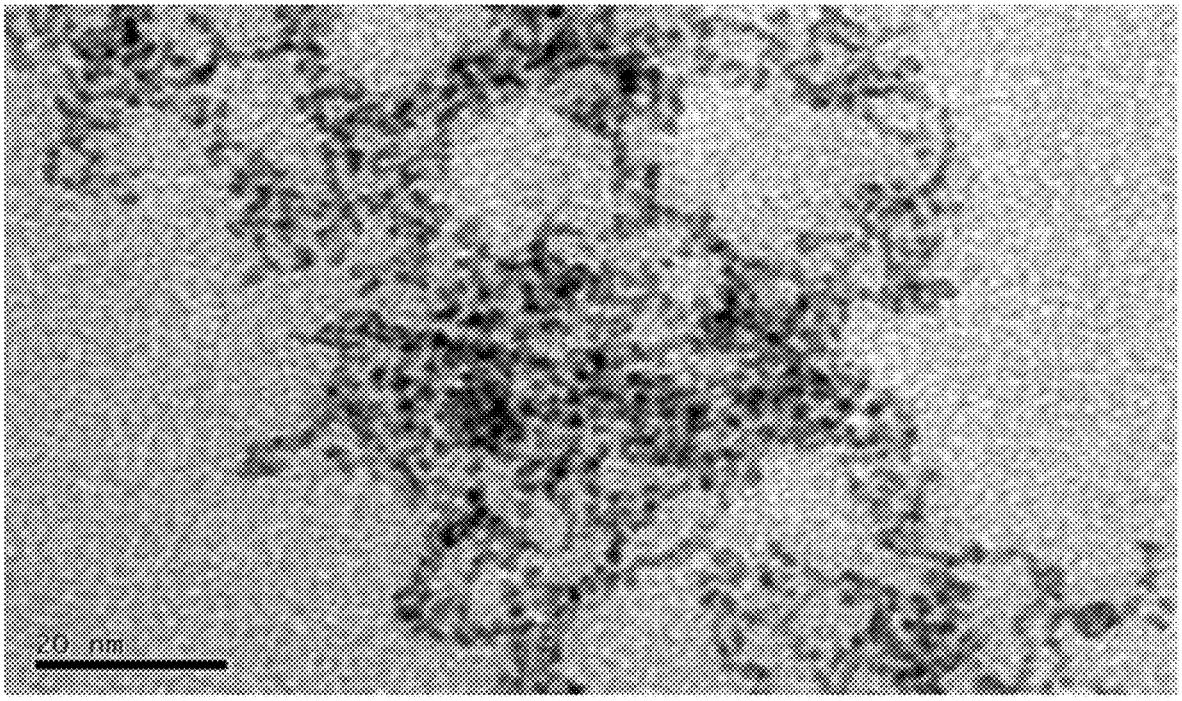
FIG. 5 is a perspective view of the TEM images of ultra small (~2 nm) ruthenium particles synthesized at 2.64 mM $LiBH_4$ concentration in $RuCl_3$ solution.

The same method discussed in this invention was able to produce other metal particles of ultra small size in aqueous solution. FIG. 5 shows a representative TEM image of ruthenium ultra small nanoparticles.

EXAMPLES

Following examples are given by way of illustration therefore should not be construed to limit the scope of the invention.

Example 1-2

Preparation of Metal Nanoparticles

Example 1

2 ml of 1% (weight/volume) $AuCl_3$ solution was prepared in water and it was further diluted by adding 248 ml water. The above solution was used to prepare a series of $LiBH_4$ solutions with vigorous stirring at room temperature [25° C.] for ranging from 0.02 mM, 0.04 mM, 0.08 mM, 0.17 mM, 0.33 mM, 0.66 mM, 1.32 mM, 2.64 mM, 5.28 mM, 8 mM and 10.56 mM of $LiBH_4$ in $AuCl_3$ solution prepared in Milli Q water. In less than 15 minutes of dissolving $LiBH_4$ in $AuCl_3$ solution, we have observed the formation of gold nano-particles and optical images of colloidal suspension of gold nanoparticles at various $LiBH_4$ molar concentrations shown in FIG. 1.

Example 2

A series of $LiBH_4$ solutions were prepared ranging from 0.02 mM, 0.04 mM, 0.08 mM, 0.17 mM, 0.33 mM, 0.66 mM, 1.32 mM, 2.64 mM, 5.28 mM, 8 mM and 10.56 mM by dissolving in 248 ml water. To this 2 ml of 1% (w/v) $AuCl_3$ solution prepared in water was added with vigorous stirring for 5 minutes and colloidal nanoparticles were formed. The reaction was completed in less than 15 minutes that included preparation of $LiBH_4$ solution and mixing with $AuCl_3$. The changes in blue to red colour colloidal solutions were observed with $LiBH_4$ concentration ranging from 0.02 mM to 10.56 mM. There were no observable difference in the optical properties of AuNPs prepared in example 1 and example 2.

Example 3

The method as described in example 1 and 2 was used to produce well dispersed colloidal aqueous solution of ultra small ruthenium nanoparticles (using 1% weight to volume ration) at room temperature [25° C.] in 2.65 mM of $LiBH_4$.

Example 4-7

Stability of Gold Nanoparticles

Example 4

For changing pH of AuNP colloidal solution 0.2 μL, 0.4 μL, 8 μL and 12 μL of 1N NaOH was added in 5 ml of AuNPs synthesized with 2.64 mM of $LiBH_4$ which resulted into pH 8, pH 9, pH 10 and pH 10.8, respectively.

For changing pH of AuNP colloidal solution in acidic range 0.4 μL, 1 μL, 10 μL, 12 μL and 25 μL of 1N NaOH was added in 5 ml of AuNPs synthesized with 2.64 mM of $LiBH_4$ which resulted into pH 7, pH 6, pH 5, pH 4 and pH 3, respectively.

Stability of these particles was observed at these pH values. There were no observable difference in the optical properties of AuNPs as prepared in example 1 and example 2.

Example 5

5 ml of gold nanoparticles colloidal suspension synthesized at 2.64 mM $LiBH_4$ dissolved in $AuCl_3$ aqueous solution at room temperature [25° C.] and exposed to various pH buffer solutions (between 3 to 11). 5 mL AuNP solution was added in 5 mL citrate buffer pH (varying pH 3 to 5), 5 ml phosphate buffer pH (5, 6 and 8) and 5 ml NaOH—HCl buffer pH (from 9 to 10.6) and had showed stable colloidal suspension (FIG. 1).

Example 6

Using the method described in this invention, highly dispersed colloidal aqueous solution of gold particles prepared which can maintain their colloidal nature at high temperature (tested at ~120° C.) and pressure (tested at ~15 lbs). 5 ml of gold nanoparticles colloidal suspension synthesized at 2.64 mM $LiBH_4$ dissolved in $AuCl_3$ aqueous solution at room temperature [25° C.] was placed in Autoclave which has temperature 121.5° C. and 15 lbs pressure for 20 minutes. There were no observable difference in the optical properties of AuNPs prepared in example 1 and example 2.

Example 7

1 ml of gold nanoparticles colloidal suspension synthesized at 2.64 mM $LiBH_4$ dissolved in $AuCl_3$ aqueous solution at room temperature [25° C.] was placed at different centrifugal speeds (1,0000, 20000, 30000 and 40000 rpm) and these particles still can maintain their colloidal nature.

Functionalization of Gold Nanoparticles

Example 8

Figure 6:
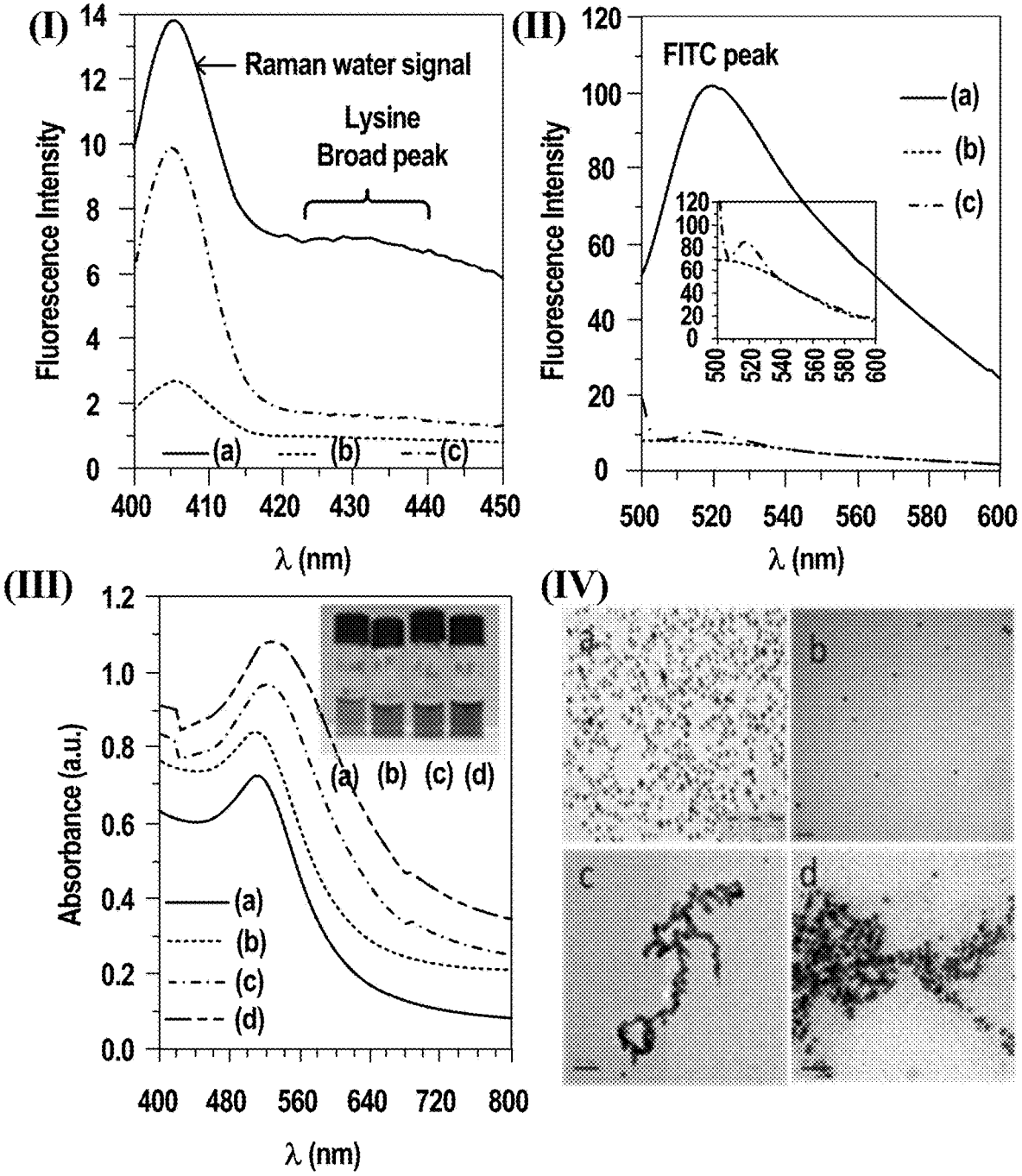
FIG. 6 is a perspective view of the functionalization of AuNPs with 1-lysine, FITC, FITC and lysine. (I)—Lysine fluorescence (Ex/Em-355/~435), (a) Lysine, (b) LBH-AuNP-Lysine (AL) and (c) LBH-AuNP-FITC-Lysine (AFL). (II)—FITC fluorescence (Ex/Em-488/520). (a) FITC, (b) AuNP-FITC and (c) AuNP-FITC-Lysine and inset showing magnifying spectra of b & c. (III)—UV-Vis of (a) LBH-AuNPs (b) LBH-AuNP-FITC (AF), (c) LBH-AuNP-Lysine (AL), (d) LBH-AuNP-FITC-Lysine (AFL) and inset showing image of corresponding colloidal colour solution. (IV) TEM image of corresponding functionalization. Scale bar of (a) 50 nm, (b), (c) and (d) 20 nm.
Figure 7:
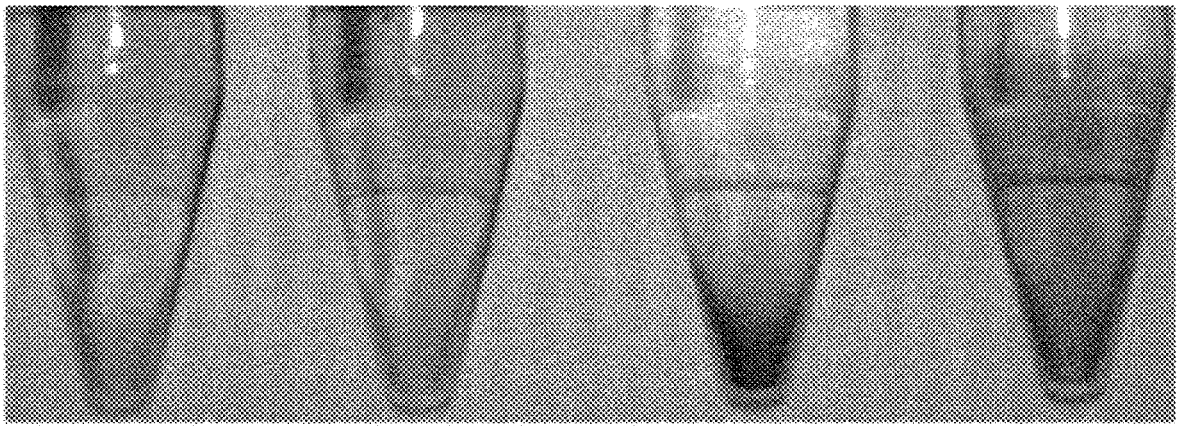
FIG. 7 is a perspective view of the optical image of citrate AuNP functionalizations. (a) AuNP, (b) AuNP-FITC, (c) AuNP-Lysine (precipitated), (d) AuNP-Lysine-FITC (precipitated).

Gold nanoparticles colloidal suspension synthesized at 2.64 mM $LiBH_4$ dissolved in $AuCl_3$ aqueous solution at room temperature were used for preparation of bi-ligand functionalized AuNP LBH-FITC-Lysine (AFL NPs) and mono functionalized AuNP LBH-FITC (AF), AuNP LBH-lysine (AL) nanoparticles. The bi-ligand functionalized AFL NPs were synthesised in two steps (a) To the 5 ml of 1.2 μM of AuNPs solution 50 μl of 500 μM FITC solution (Dissolved in 95% ethanol) was added with final concentration of 5 μM FITC in AuNPs and incubated for 30 mins, then (b) To the (a) solution, 100 μl of 100 mM of lysine added with final concentration of 2 mM lysine in AuNPs solution and incubated for 30 mins. In both reactions (a) and (b) saturated concentration of FITC and lysine were used respectively. Similarly, for AF and AL solutions preparation, 5 ml of 1.2 μM AuNPs solution contain final concentration of 5 μM FITC and 2 mM of lysine respectively. All the reactions were incubated for 30 mins at room temperature and further FIG. 6 shows absorption and fluorescence spectrometric analysis. In prior art [R. Shukla, V. Bansal, M. Chaudhary, A. Basu, R. R. Bhonde, M. Sastry, Langmuir 2005, 21, 10644-10654] the successful demonstration of co-functionalisation of lysine and FITC with AuNPs showed with limited stability at higher concentration. Whereas, lithium borohydride-Gold nanoaprticles (LBH-AuNPs) synthesized in this invention are small in size (<5 nm) and are highly stable and can resist higher concentration of bi-ligand co-functionalizations (Lysine and FITC).

Example 9

Gold nanoparticles colloidal suspension synthesized at 2.64 mM $LiBH_4$ dissolved in $AuCl_3$ aqueous solution at room temperature [25° C.] were used for preparation of bi-ligand functionalized in example 8 were used for quantification for fluorometric estimation of collagen. A series of collagen concentration was prepared in 2 ml of AFL nanoparticles synthesized in example 8 with final concentration 2 to 10 μg/ml from 100 ug/ml of stock collagen solution. For the real time collagen estimation, rat tail collagen was extracted and concentration was adjusted to 1 mg/ml. The respective AFL-collagen solution was incubated 12-14 hrs at 4° C. The reactions were analyzed and characterized by fluorescence spectrometry and Transmission electron microscopy.

Advantages of the Invention

The main advantages of the present invention are:

- The method described for synthesis of metal particles used in this invention is a one step rapid process in polar solvents. This does not require the use of non-polar solvents which are normally not desirable due to adverse effect on the environment.
- The method used in this invention, is rapid, fascile and single step process to achieve ultra-small size of metal nanoparticles, which are difficult to get in other non-polar solvent systems. For example synthesis of nanoparticle size <10 nm using non-polar solvent, which is tedious and cumbersome process.
- As these metal particles were synthesized in aqueous solution, this provides greater flexibility in using these metal nanoparticles for a wide range of applications in medicine, diagnostics, imaging etc., whereas, nonpolar solvents may not be desirable.
- A method for producing metal particles, specifically ultra-small size, highly colloidal and dispersive nanoparticles prepared from water soluble metal chlorides and hydrides using $LiBH_4$ reducing agent.
- The synthesis of well dispersed colloidal aqueous solution of metal particles stable at various pH buffer solutions and using these at similar or modified physical, chemical and biological environments.
- The synthesis of the metal particles including ultra small size which can tolerate high sodium chloride concentration and can maintain their colloidal nature at high temperature and using these at similar or modified physical, chemical and biological environments.
- The synthesis of the metal particles including ultra small size which can tolerate higher concentration of functional molecules, including biomolecules of different functional nature during functionalization and co-functionalisation with different biomolecules having several functional groups and using these at similar or modified physical, chemical and biological environments.

We claim:

1. A process for the preparation of metal nanoparticles, said process comprises:

stirring a first composition consisting of lithium borohydride ($LiBH_4$) and optionally water and a second composition consisting of a metal salt and water for 1 to 15 minutes at a temperature that ranges from 25° C. to 35° C. thereby forming a product comprising the metal nanoparticles;

wherein the weight ratio of $LiBH_4$ to the metal salt ranges from about 0.7 to about 3;

wherein the metal salt is selected from the group consisting of $AuCl_3$, AgCl, $HAuCl_4$, $RuCl_3$, $H_2PtCl_6$ $PdCl_2$, $CuCl_2$, and $PtCl_4$.

2. The process of claim 1, wherein the first composition consists of solid $LiBH_4$.

3. The process of claim 1, wherein the first composition consists of $LiBH_4$ and water.

4. The process of claim 1, wherein the weight ratio of $LiBH_4$ to the metal salt ranges from about 1.4 to about 3.

5. The process of claim 1, wherein the weight ratio of $LiBH_4$ to the metal salt ranges from about 2.2 to about 3.

6. The process of claim 1, wherein the weight ratio of $LiBH_4$ to the metal salt ranges from about 0.7 to about 2.2.

7. The process of claim 1, wherein the metal salt is $AuCl_3$.

8. The process of claim 7, wherein the mole ratio of $LiBH_4$ to $AuCl_3$ ranges from about 10 to about 40.

9. The process of claim 7, wherein the mole ratio of $LiBH_4$ to $AuCl_3$ ranges from about 10 to about 30.

10. The process of claim 7, wherein the mole ratio of $LiBH_4$ to $AuCl_3$ ranges from about 10 to about 20.

11. The process of claim 7, wherein the mole ratio of $LiBH_4$ to $AuCl_3$ is about 10.

12. The process of claim 1, wherein the metal nanoparticles have an average particle size of about 2 nm to about 5 nm as measured by dynamic light scattering.

13. The process of claim 1, wherein the metal nanoparticles have an average particle size of about 2 nm as measured by dynamic light scattering.

14. The process of claim 1, wherein the metal nanoparticles are colloidal in an aqueous medium having a pH that ranges from about 3 to about 12.

15. The process of claim 1, further comprising reacting the metal nanoparticles with a first ligand thereby forming mono-ligand functionalized metal nanoparticles and reacting the mono-ligand functionalized metal nanoparticles with a second ligand thereby forming bi-ligand functionalized metal nanoparticles.

16. The process of claim 15, wherein the first ligand is lysine and the second ligand is fluoroscein isothiocyanate (FITC).

* * * * *